United States Patent [19]

Bernard

[11] 3,987,496

[45] Oct. 26, 1976

[54] INTERNAL BELT FOR GARMENTS

[75] Inventor: Christian Bernard, Mouvaux, France

[73] Assignee: Dollfus Mieg & Cie, Paris, France

[22] Filed: Feb. 28, 1975

[21] Appl. No.: 554,095

[30] Foreign Application Priority Data

Mar. 5, 1974 France ..... 74.07412

[52] U.S. Cl. ..... 2/220; 2/236

[51] Int. Cl.[2] ..... A41F 9/00

[58] Field of Search ..... 2/236, 220, 221, 237, 2/76

[56] References Cited

UNITED STATES PATENTS 3,571,814 3/1971 Miller ..... 2/236

FOREIGN PATENTS OR APPLICATIONS 1,371,376 7/1964 France ..... 2/236

944,181 6/1956 Germany ..... 2/237

*Primary Examiner*—H. Hampton Hunter

*Attorney, Agent, or Firm*—Davis, Hoxie, Faithfull & Hapgood

[57] ABSTRACT

Internal or integrated belt, for a garment such as a skirt or pair of trousers, which is constituted of a band, of any suitable material, folded around a reinforcing piece, to which band there is firmly attached a tape, between which tape and the band there is inserted the upper edge of the fabric constituting the garment.

7 Claims, 4 Drawing Figures

INTERNAL BELT FOR GARMENTS

This invention concerns, as new industrial product, an internal belt or integrated belt for a garment, such as a skirt or pair of trousers.

The principal objective of the invention is to provide a belt of the type in question, which is of especially simple design and lends itself to prefabrication, and which is capable of being rapidly fitted onto a garment, by any person even a non-skilled person, without the use of special equipment.

The belt according to this invention is characterised essentially in that it comprises a band, which may with advantage be formed of a lining material or taffeta, which is folded around a reinforcing piece of any suitable material, to which band there is firmly attached a tape, between which tape and the band the upper edge of the material is inserted. This material of the garment is, during the assembly operation, folded around said tape, the band being folded over and fixed, for example by stitching, onto the face of the material which will constitute the reverse of the garment such as a pair of trousers or skirt.

The various characteristics and advantages of the invention will become apparent from the description below of one of its possible forms of embodiment.

It is of course to be understood that this is solely an example, and that any other forms, proportions and arrangements could be adopted without thereby departing from the scope of this invention.

Figure 1:
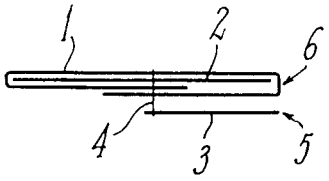
Figure 2:
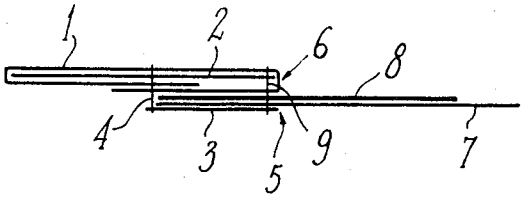
Figure 3:
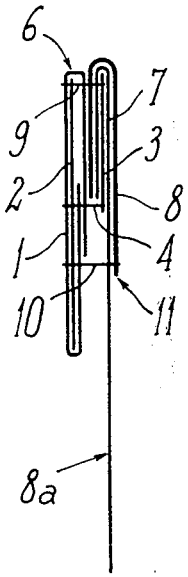
Figure 4:
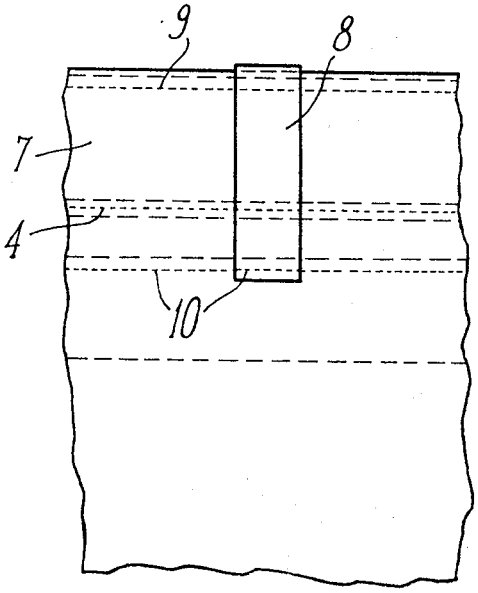

In this description, reference will be made to the attached drawing, which shows:

FIG. 1 a cross-sectional view of an internal belt according to this invention, FIG. 2 a view analogous to that of FIG. 1 of the same belt, after the fabric of the garment has been inserted between the two parts of the belt, FIG. 3 a side view of the belt after it has been placed and fixed, FIG. 4 a partial front view of the region of the garment, with the belt in place.

The internal belt is constituted in accordance with this invention of a band 1, which may with advantage consist of a lining material or taffeta, folded over as can be seen notably in FIGS. 1 and 2 around a reinforcing piece 2. This reinforcing piece is of any suitable material, such as for instance linen, or of non-woven fabric. A tape 3 is attached to the band 1, for example by stitching 4, this stitching being provided close to one of the edges of the tape, the opposite edge of which reaches approximately to the level of the corresponding edge 6 of the band 1, or may project slightly beyond this edge.

The function of the tape 3 is to prevent stretching of the band and therefore of the belt and, by the same token, stretching of the garment itself, usually a skirt or pair of trousers, at waist level. It also has the effect of stiffening the belt. This tape also is of any suitable woven or non-woven material.

The fitting of the belt onto the garment 7, such as pair of trousers or skirt in the example shown, is first carried out as indicated in FIG. 2, by inserting the fabric of the trousers or skirt, onto which loops such as 8 for the external belt have been already fitted, between the band 1 and the tape 3; these various elements being joined together by machine stitching 9, or by any other means of attachment.

The integrated belt is then, as shown in FIG. 3, folded over in such a way that it is applied to the reverse of the trousers (or skirt).

The components are preferably so arranged, in advance, that the edge 5 of the tape 3 projects by a slight amount beyond the upper edge 6 of the band, so that this band shall not be visible when the trousers or skirt are worn by the wearer.

When once the integrated belt has been folded over against the reverse **8*a* of the trousers (or skirt), it is attached to this garment by machine stitching 11, this stitching firmly connecting together the various elements of this integrated belt, the fabric 7 and the loops such as 8**, in the vicinity of their lower edge.

It can be seen from the foregoing that the fitting of the belt according to this invention, which is supplied ready for fitting, is extremely easy to carry out.

With regard to the belt itself, its design is sufficiently simple to make its cost very advantageous.

It may be noted, in addition, that the belt according to this invention, the prefabricated trouser fly forming the subject of U.S. Pat. Nos. 3,789,430 and 3,795,920 have all been designed to be brought together at a stage preceding the making up of the garment, thus enabling an assembly to be obtained which lends itself to manufacture in an especially simple manner, by any non-specialised person, of garments such as notably trousers and skirts.

The invention may of course give rise to numerous variants, without thereby departing from its principle.

What I claim is:

1. The combination of an interior or integrated belt and a garment such as skirt or pants, said belt comprising a band of textile material, a reinforcing strip, said band being folded over the upper edge of said strip and toward the interior face of the garment, a tape, means attaching said tape to said belt through the folded-over part of said band; the edge of the material of which the garment is made being inserted between said tape and said folded-over part of said band, said garment material being folded over said tape with said belt being disposed adjacent the inner face of the garment, means securing said folded-over edge of the garment in said inserted position.

2. The combination according to claim 1, characterised in that the band consists of a lining material or taffeta.

3. The combination according to claim 1, characterised in that the reinforcing piece which the band encloses is a woven product, such as linen, or a non-woven product.

4. The combination according to claim 1, characterised in that the tape is of a material for stiffening the belt and for preventing stretching of the garment at the waist level.

5. The combination as claimed in claim 1 in which the belt portion of the combination is prefabricated and the tape is stitched to the band.

6. The combination as claimed in claim 1 in which the prefabricated belt portion is stitched to the folded-over part of said garment material, and the belt portion is also stitched to the garment through the outer face of the garment near the lower edge of the belt portion.

7. The combination as claimed in claim 1 in which the folded-over part of said band is below the folded-over part of said garment material so that said band is hidden when the garment is worn.

* * * * *